United States Patent [19]

Dal Palu'

[11] Patent Number: 4,901,547

[45] Date of Patent: Feb. 20, 1990

[54] SPARE CAR KEY AND PLATE HOLDER

[75] Inventor: Attilio Dal Palu', Rivoli, Italy

[73] Assignee: Fabbrica Italiana Serrature Torino Fist S.p.A., Turin, Italy

[21] Appl. No.: 271,626

[22] Filed: Nov. 15, 1988

[30] Foreign Application Priority Data

Nov. 17, 1987 [IT] Italy ..... 67980 A/87

[51] Int. Cl.[4] ..... A47G 29/10

[52] U.S. Cl. ..... 70/408; 24/3 K; 24/163 K; 70/456 R; 70/457; 70/458; 206/37.1; 206/38.1

[58] Field of Search ..... 70/408, 456 R, 456 B, 70/457, 458; 206/37.1, 37.3, 37.4, 38.1; 224/163; 24/3 K, 163 K

[56] References Cited

U.S. PATENT DOCUMENTS

| | | | |
|---|---|---|---|
| 2,201,127 | 5/1940 | Schechter | 70/455 |
| 2,625,190 | 1/1953 | Dimond | 206/37.6 |
| 3,407,636 | 10/1968 | Kovacevic | 70/456 R |
| 3,481,168 | 12/1969 | Unter | 70/458 |
| 3,568,482 | 3/1971 | Shears | 70/456 B |
| 3,583,317 | 6/1971 | Gibson | 101/369 X |
| 4,286,641 | 9/1981 | Watson | 206/37.4 |
| 4,454,737 | 6/1984 | Toyoda | 70/456 R |
| 4,637,236 | 1/1987 | Almblad | 70/458 |

FOREIGN PATENT DOCUMENTS

| | | | |
|---|---|---|---|
| 592908 | 2/1960 | Canada | 70/456 R |
| 845526 | 8/1960 | United Kingdom | . |

*Primary Examiner*—Lloyd A. Gall

*Attorney, Agent, or Firm*—Kane, Dalsimer, Sullivan, Kurucz, Levy, Eisele and Richard

[57] ABSTRACT

A spare car key comprising a metal core defined by a grip portion and by an active portion designed to cooperate with a respective lock, and housed in removable manner in the center portion of a plate to which it is secured by means of a flexible appendix on the plate itself.

4 Claims, 1 Drawing Sheet

SPARE CAR KEY AND PLATE HOLDER

BACKGROUND OF THE INVENTION

The present invention relates to a spare car key. Cars are usually supplied by the maker with two sets of keys, each comprising a main key, for routine key-control led functions, such as opening the doors or tail gate, releasing the steering lock, or starting the engine, and a spare key for use by garage or repair shop personnel and designed, for security reasons, for preventing the performance of specific functions, such as opening the tail gate. Said keys comprise a metal core having a flat grip portion engraved with the key identification number, and on which a plastic grip is subsequently molded. As, for security reasons, the identification number is only legible by breaking off the plastic grip, a number plate is usually supplied with the keys, for obtaining a duplicate from the maker in the event of the key being lost.

A major drawback of keys of the aforementioned type is that they are so bulky that users generally tend to carry only one set of keys (or even only the main key), which limits to some extent the usefulness of a spare set. A further disadvantage is the relatively high cost of providing four keys and the relative number plate.

SUMMARY OF THE INVENTION

The aim of the present invention is to provide a spare car key designed to overcome the aforementioned drawbacks typically associated with known types of keys. With this aim in view, according to the present invention, there is provided a spare car key comprising a metal core defined by a substantially flat active and grip portion integral with each other; characterized by the fact that it comprises a plate having a center portion housing said metal core in at least partially removable manner, and having means for securing said metal core inside said center portion.

BRIEF DESCRIPTION OF THE DRAWINGS

A preferred non-limiting embodiment of the present invention will be described with reference to the accompanying drawings, in which.

DETAILED DESCRIPTION OF THE DRAWINGS

Figure 1:
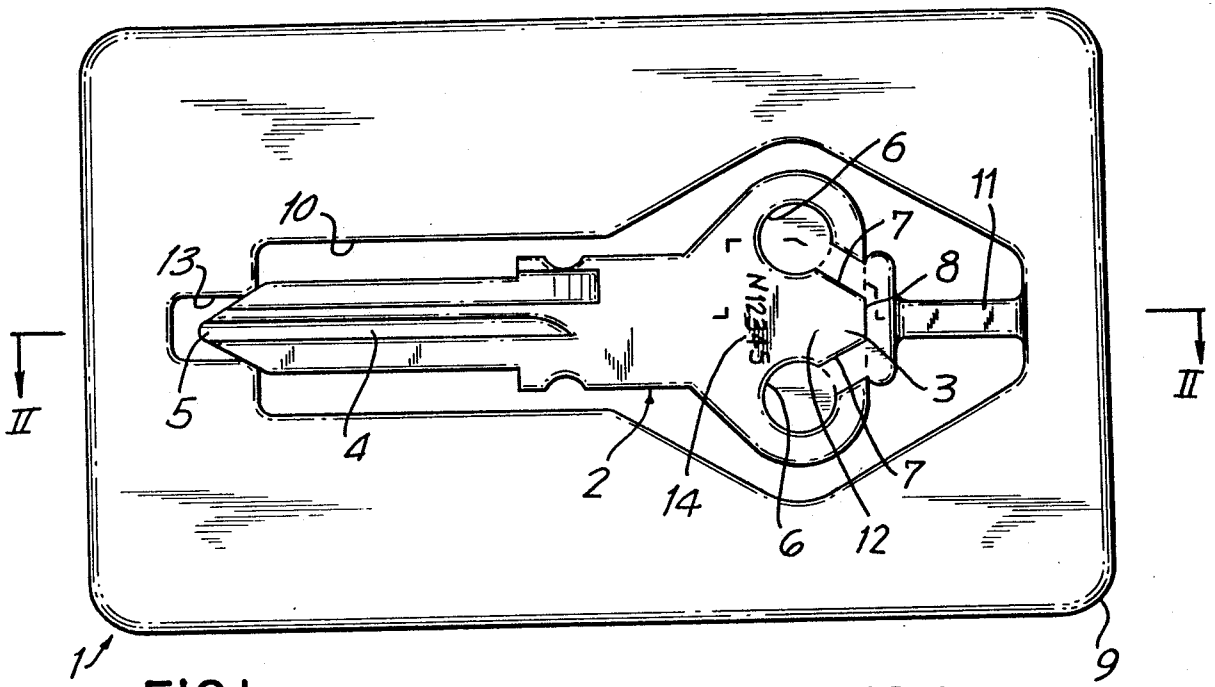
FIG. 1 shows a top plan view of a spare key in accordance with the teachings of the present invention.
Figure 2:
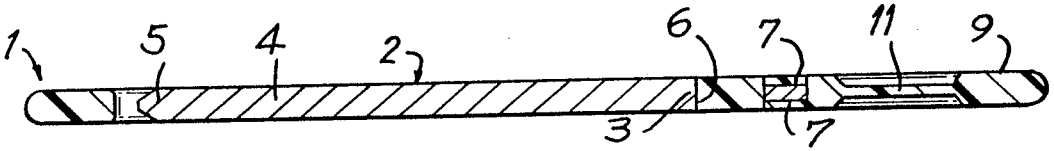
FIG. 2 shows a section along line II–II in FIG. 1.

Number 1 in the accompanying drawings indicates a spare car key comprising a standard metal core 2 consisting of a flat grip portion 3 and an elongated active portion 4 designed in known manner for performing all the key-controlled functions on the car (unlocking, ignition, steering lock release) and having a pointed lead-in end 5. Said grip portion 3 presents a pair of through holes 6 and, on each face, a respective pair of converging grooves 7 extending radially from respective holes 6 towards edge 8 of portion 3, opposite said active portion 4. Said grip portion 3 is engraved with a number 14 identifying key 1. According to the present invention, key 1 comprises a substantially rectangular plate 9 conveniently molded from plastic material, having rounded edges and corners, and of substantially the same thickness as metal core 2. Said plate 9 also presents a center through portion 10 designed to receive metal core 2.

Plate 9 and metal core 2 are connected together during molding of plate 9. For this purpose, the liquid plastic material is fed from the mold cavity defining plate 9 along grooves 7 and into holes 6. Upon setting, said plastic material defines a thin flexible appendix 11 extending from plate 9 into center portion 10, and having a portion 12 anchoring grip portion 3 of metal core 2. Center portion 10 also defines a seat 13 housing lead-in end 5, in slightly tight-fitting manner, so as to lock metal core 2 inside portion 10.

Key 1 operates as follows.

In the event of either of the car keys being lost, metal core 2 of key 1 is removed from center portion 10 of plate 9 by simply applying pressure on active portion 4, so as to release end 5 from seat 13, and then flexing appendix 11. Key 1 may thus be employed in known manner for unlocking the car doors, starting the engine, etc., and subsequently returned to the position shown by virtue of appendix 11 flexing back into its original position. The advantages of key 1 according to the present invention will be clear from the foregoing description.

Firstly, it is extremely compact, about the same size as a credit card, thus enabling it to be carried on the user's person, e.g. inside a wallet, ready for use in the event of either of the keys being lost. Secondly, it provides for reducing cost, by virtue of key 1 replacing both the main and less frequently used secondary key in the spare set, and being engraved with the identification number, thus enabling the identification plate to be dispensed with. As key 1 is used exclusively by the owner, there is absolutely no danger of the identification number engraved on it being used for obtaining unauthorized duplicates. To those skilled in the art it will be clear that changes may be made to key 1 as described and illustrated herein without, however, departing from the scope of the present invention.

I claim:

1. A spare car key comprising a metal core (2) defined by a substantially flat active portion (4) and grip portion (3) integral with each other and a plate (9) molded from plastic material and having a center through portion (10) housing said metal core (2) in at least partially removable manner, said metal core (2) being secured inside said center through portion (10) by a flexible appendix (11) integral with said plate (9), extending from said plate (9) into said center through portion (10) and having an anchoring portion (12) molded on to said grip portion (3) of said metal core (2).

2. A key as claimed in claim 1, characterised by the fact that a securing means comprise a seat (13) defined by said center through portion (10) of said plate (9) and engaged in slightly tight-fitting manner by the end (5) of said active portion (4) opposite said grip portion (3).

3. A key as claimed in claim 1, characterised by the fact that said metal core (2) presents a visible identification number (14).

4. A key as claimed in claim 1, characterised by the fact that said plate (9) is of substantially the same thickness as said metal core (2).

* * * * *